United States Patent [19]

Ikegame

[11] 4,225,081

[45] Sep. 30, 1980

[54] METALLIC JOINT FOR MODEL RAILROAD RAILS

[75] Inventor: Osamu Ikegame, Tokyo, Japan

[73] Assignee: Tomy Kogyo Co., Inc., Tokyo, Japan

[21] Appl. No.: 705,549

[22] Filed: Jul. 15, 1976

[30] Foreign Application Priority Data

Jul. 29, 1975 [JP] Japan ..... 50-105680[U]

[51] Int. Cl.[3] ..... A63H 19/30

[52] U.S. Cl. ..... 238/10 E; 238/10 B

[58] Field of Search ..... 238/10 R, 10 A, 10 B, 238/10 C, 10 E, 10 F; 104/60, 147 A, DIG. 1; 46/1 K, 216

[56] References Cited

U.S. PATENT DOCUMENTS

| | | | |
|---|---|---|---|
| 1,142,150 | 6/1915 | Durrill | 238/10 E |
| 3,581,988 | 6/1971 | Kin et al. | 238/10 E |

FOREIGN PATENT DOCUMENTS

| | | | |
|---|---|---|---|
| 1169824 | 5/1964 | Fed. Rep. of Germany | 238/10 E |
| 1255076 | 1/1961 | France | 238/10 E |
| 545033 | 5/1942 | United Kingdom | 238/10 E |

*Primary Examiner*—Randolph A. Reese

*Attorney, Agent, or Firm*—Staas & Halsey

[57] ABSTRACT

This invention relates to a metallic joint for joining adjacent sections of the trackway of model railroad sets, and wherein the bottom of the joint is provided with a cut-out section which is folded downwardly to form an engaging pawl which snaps in place within a cavity formed within the upper surface of the support for the rails.

2 Claims, 6 Drawing Figures

METALLIC JOINT FOR MODEL RAILROAD RAILS

BACKGROUND AND SUMMARY OF THE INVENTION

The present invention relates to model railroad systems wherein metallic rails are mounted on tie-shaped supports which are formed as an integral part of the roadbed which is constructed of a suitable insulating material, for example, plastic. In such model railroad systems, the sections of the rail are usually secured together with metallic joints. To prevent the metal joints from disengaging from the ends of adjacent rail sections, the edges of the joints are usually folded and fastened to adjacent sections of the rail. But it will be readily apparent that the joints described above not only increase the cost of the model railroad system but also result in troublesome assembly. To eliminate these disadvantages, the invention disclosed herein employs a metallic joint that is provided along the bottom thereof with a cut-out portion which is folded downwardly so as to form an engaging pawl so designed as to fit within a cavity formed as a part of the upper surface of the rail supports at each end of the section of trackway.

DESCRIPTION OF THE PREFERRED EMBODIMENT

Figure 1:
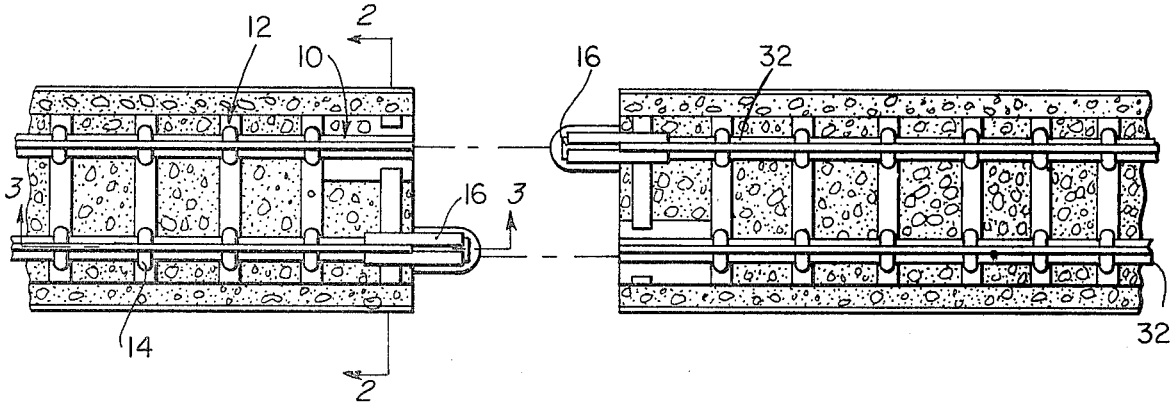
FIG. 1 is a top plan view of the end portions of adjacent trackway sections according to the present invention.

As illustrated in FIG. 1, the reference numeral 10 designates generally the rails which are constructed of an electrically conductive material while the reference numeral 12 designates tie-shaped supports which are formed of plastic and which are provided with pairs of L-shaped edges 14 which secure the edges of the rails 10 to the supports 12.

Figure 4:
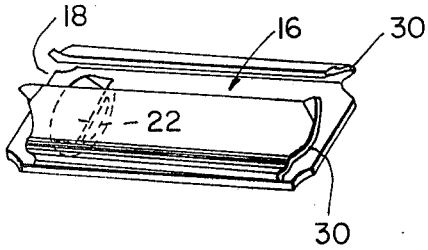
FIG. 4 is a perspective view of one of the metallic joints according to the present invention, illustrating in particular the cut-out portion which is locked in place within the cavity of the end of the track section.

The metallic joints 16 are used to connect adjacent sections of the trackway and are provided as illustrated in FIG. 4 with an opening 18 extending along the top thereof through which the upper portion 20 of each rail 10 can extend. The bottom of each of the joints 16 is provided with a cut-out portion 22 which extends downwardly to function as a pawl, as will be apparent hereinafter.

Figure 3:
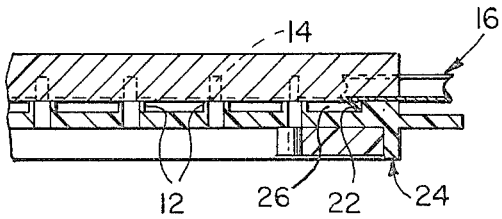
FIG. 3 is a sectional view taken along line 3—3 of FIG. 1.
Figure 5:
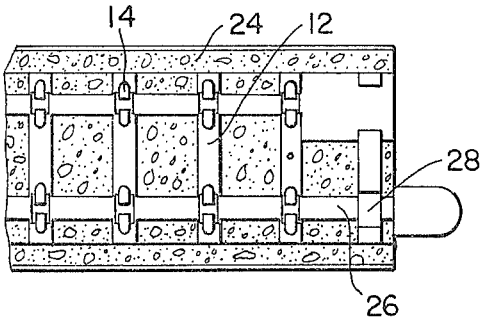
FIG. 5 is a top plan view of an end portion of the trackway with the rail removed so as to expose the construction of the supports and cavity within which the cut-out portion of the joint is positioned.
Figure 6:
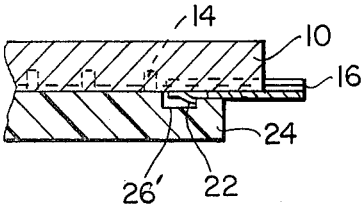
FIG. 6 is a sectional view of another embodiment of the present invention, illustrating the formation of the cavity within the roadbed of the trackway.

Turning now to FIG. 3, it will be apparent that the supports 12 are positioned transversely across the roadbed 24. As a matter of convenience, the supports 12 and the roadbed 24 are molded together of plastic material as a unitary element. At each end of each section of the trackway there is provided a cavity 26 within which the cut-out portion 22 of the joint 18 is designed to fit. It will be apparent that the cavity 26 may be constructed in different ways. As illustrated in FIGS. 3 and 5, the cavity may be formed by leaving a small portion 28 of the support 12 at the end of the track section available to retain the edge of the cut-out portion 22 of the joint 16 so as to confine the cut-out portion 22 within the cavity 26. Alternatively, and as illustrated in FIG. 6, the cavity 26' may be formed within the top of the roadbed 24.

Figure 2:
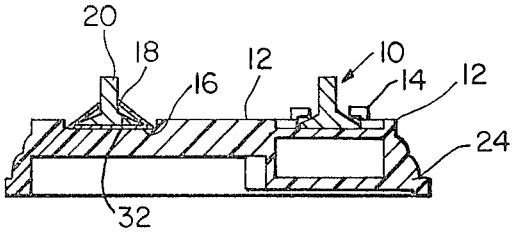
FIG. 2 is a sectional view taken along line 2—2 of FIG. 1.

From the foregoing, it will be apparent that adjacent of the sections of the trackway are connected by initially inserting the joints 16 in place on opposite sides of the rails 10, as illustrated in FIG. 1. From FIGS. 2 and 4, it will be apparent that the side portions 30 of the joints 16 are curvilinear permitting the joints 16 to slide along the base 32 of the rails 10. Then, the trackway sections are joined together causing the cut-out portions 22, i.e., the pawls, to be securely lodged within the cavities 26, at which time the adjacent rail sections 10 are securely locked together.

Finally, it will be noted that the utter simplicity of the construction of the joints 16 results in substantial savings in manufacturing costs, and, moreover, reduces substantially the likelihood of the rail sections becoming unconnected during use.

I claim:

1. In a trackway having a plurality of sections each provided with a base, a plurality of supports extending upwardly from said base, extending transversely thereof, and spaced apart from each other, and rails mounted to said supports and extending longitudinally along said base, each of said rails having a bottom portion resting on said supports and a top portion extending upwardly therefrom, the improvement comprising a system for connecting the end portions of adjacent of said rails of adjacent sections, comprising joints, each of said joints having top, bottom and interconnecting side portions, said top portion being provided with a slot extending longitudinally therealong through which said top portions of adjacent of said rails extend, said bottom portion and said side portions encompassing said bottom portions of adjacent of said rails, said bottom portion furthermore being provided at one end thereof with a cut-out section extending downwardly therefrom defining a pawl, said supports at the ends of each section of said trackway having portions extending upwardly from said base distances corresponding to the distances the remainder of said supports extend upwardly from said base defining cavities between said supports at the ends of said section and the adjacent of said supports, such that said pawls of said joints abut said supports at the ends of each section until sufficient pressure is applied thereto at which time said pawls pass over said supports at the ends of each section eventually becoming locked between said supports at the ends of each section and the adjacent of the remainder of said supports, said supports at the ends of each section extending only partially transversely across said base and being arranged on opposite sides of each of said sections such that the ends of said joints opposite said pawls can be freely slid along said rails without contacting said supports at the ends of each section into abutment against the adjacent of the remainder of said supports.

2. A trackway as in claim 1, wherein said base and supports are made of electrically insulating material and said rails are made of electrically conductive material.

* * * * *